United States Patent [19]

Poythress et al.

[11] Patent Number: 4,871,055

[45] Date of Patent: Oct. 3, 1989

[54] AMUSEMENT DEVICE FOR COLLECTING COINS

[76] Inventors: Cecil A. Poythress, 898 S. Myrtle Ave.; Ronald Wharton, 1390 Tumblin Dr., both of New Smyrna Beach, Fla. 32069

[21] Appl. No.: 144,332

[22] Filed: Jan. 15, 1988

Related U.S. Application Data

[63] Continuation-in-part of Ser. No. 97,958, Sep. 17, 1987.

[51] Int. Cl.[4] ..... G07F 9/06

[52] U.S. Cl. ..... 194/344; 194/352; 446/8; D99/35

[58] Field of Search ..... 194/344, 350, 352; 221/24, 3; 193/12, DIG. 1; 446/8–13, 168; 273/86 C, 112, 120 R, 120 A; D99/34–36

[56] References Cited

U.S. PATENT DOCUMENTS

| | | | |
|---|---|---|---|
| 166,978 | 8/1875 | Feigl | 446/8 |
| D. 289,218 | 4/1987 | Divnick | D99/34 |
| 495,241 | 4/1893 | Braun | 221/3 X |
| 2,719,041 | 9/1955 | Stefanelli et al. | 446/8 X |
| 4,324,059 | 4/1982 | Baum | 221/24 X |
| 4,762,512 | 8/1988 | Divnick | 206/0.8 X |

FOREIGN PATENT DOCUMENTS

| | | | |
|---|---|---|---|
| 2416518 | 8/1979 | France | 194/352 |

*Primary Examiner*—F. J. Bartuska

[57] ABSTRACT

An amusement device has a large transparent circular funnel element having a convexly flared inner wall and an outlet. A hemispherical reflector has a concentric opening and is disposed below and spaced apart from the funnel element with the outlet extending through the opening. The funnel element is supported by a circular container. A transparent hemispherical plastic dome covers the funnel element and includes a pair of coin chutes molded therein. A coin placed at the top of a chute and released is guided to roll down the chute to be tangentially injected through an opening in the dome to roll on edge around the funnel surface. The reflector causes the rolling coin to appear to be floating in air and produces a reflection of the coin. The coin will spiral downward and drop through the outlet. A gong is mounted below the outlet and is struck by the coin. The container includes a door in its sidewall for access to a coin collection tray disposed beneath the outlet.

9 Claims, 2 Drawing Sheets

AMUSEMENT DEVICE FOR COLLECTING COINS

This application is a continuation-in-part of copending patent application Ser. No. 97,958 filed Sept. 17, 1987.

BACKGROUND OF THE INVENTION

1. Field of the Invention

The present invention relates to amusement devices and more particularly to a device which demonstrates gravity, momentum, and centrifugal force in an interesting fashion.

2. Description of the Prior Art

It is well known that a large funnel-shaped device can be used to demonstrate gravity, momentum, and centrifugal force by starting a marble or the like tangentially around the upper, inner periphery of the funnel device at sufficient velocity to impart a rotational motion thereto. As gravity pulls the marble downward, the centrifugal force produced by the circular movement and the starting momentum maintain the marble in contact with the inner walls of the funnel. The marble will then spiral downward to drop out of the bottom of the funnel. Due to conservation of momentum, the marble will experience a rapid increase in the rate of rotation as it drops causing the vertical movement to become slower as the marble descends. This principal has been incorporated into various toys. For example, U.S. Pat. No. Des. 233,057 to Irvine shows an amusement ballgame table having a convexly flared funnel and a track to launch a marble or the like onto the track. U.S. Pat. No. Des. 89,246 to Raden et al teaches a game table having a funnel-like portion. Geiser, in U.S. Pat. No. 3,092,928, shows a straight funnel having means for, launching marbles into the funnel. U.S. Pat. No. 4,251,949 to Buck et al teaches a device in which small model automobiles are launched into a cylindrical wall and are maintained in their position by centrifugal force for a period of time. U.S. Pat. No. 3,686,789 to Polonyi discloses a space toy in which a ball is tangentially injected into a bowl having convexly flared sidewalls to simulate a spacecraft in orbit.

A device known as the "Spiral Wishing Well" using this principle is in use to attract charitable contributions. This device use a funnel having a convexly flared wall mounted on a container and having a pair of tracks which permit launching of coins into the funnel such that the coins roll on edge around the funnel, spiral down and drop into a container. The present invention represents an improvement over the Spiral Wishing Well. The funnel portion of the Spiral Wishing Well is open to the elements when used out of doors and also is subject to tampering by users. For example, when unattended, the funnel could be stuffed with paper or the like preventing any coins from being collected or the exposed funnel portion could be easily damaged. The launching tracks are formed from thin plastic and extend upward from the periphery of the funnel and can therefore be easily damaged.

There is thus a need for a weatherproof funnel-type amusement device suitable for unattended charitable collections which will be secure from vandalism and tampering.

SUMMARY OF THE INVENTION

The present invention is an amusement device having a circular container body with a transparent funnel having a convexly flared wall mounted on an open top thereof. The funnel is open on the lower end. A reflector device is disposed below the funnel and includes a flat annular ring mirror portion and an essentially hemispherical mirror portion depending from the annular ring. The hemispherical portion has a central opening through which the lower end of the funnel passes. A clear plastic dome is formed and disposed completely over and securely attached to the funnel portion to restrict access to the funnel. The plastic dome also includes a pair of coin launching chutes molded into the surface of the dome. The dome also includes a flattened portion at the top for attaching a sign thereto. The funnel and reflector device include attachment means for attaching the funnel, reflector, and dome assembly to the container. At the lower portion of the container wall, a small door is provided which may be opened and a collection tray for coins inserted and removed therefrom.

The introduction of coins into the funnel via the coin chutes causes the coins to rotate on edge around the convexly flared wall with the velocity increasing as the diameter of the funnel decreases. The coins drop into the collection tray. The two coin launching chutes permit coins to be introduced rolling in opposite directions which creates an interesting pattern. Several coins may be introduced one after the other with an interesting result.

The reflector device produces an interesting effect since it multiplies the apparent number of coins in motion and causes the coin to appear to be floating in air.

To add additional interest to the natural motion of the coins down the funnel, a gong or bell is disposed adjacent the outlet of the funnel such that the coins will strike the gong as they fall into the collection box. The loudness, and to some extent, the tone of the gong will vary with the size of the coins. In other words, a penny will give a much softer sound than a quarter or half-dollar, thereby encouraging the larger coins to be used.

The invention may be used in science museums and in physics classes to dramatically demonstrate the effects of gravity, momentum, and centrifugal force. The device also is useful as a means for collecting funds for charitable organizations by providing one with the satisfaction of giving, while enjoying the fascination of observing the behavior of the coins as they fall into the collection tray and ring the bell.

Therefore, it is a principal object of the invention to provide an amusement device in which coins will roll on edge down the inner wall of a funnel in a spiral action, in which the coins appear to float in air, and which is useful for educational and charitable purposes.

It is another object of the invention to provide an amusement device utilizing coins spiraling in a funnel to demonstrate gravity, momentum, and centrifugal force in which the funnel is completely covered by a transparent dome to prevent access to the funnel.

It is still another object of the invention to provide an amusement device for attracting charitable donations of coins in which coins are caused to roll on edge in a downwardly spiraling vortex pattern and to strike a bell or gong.

It is yet another object of the invention to provide a funnel covered by a transparent dome having a pair of coin chutes molded therein which permit launching of coins on edge into the tangentially funnel.

These and other objects and advantages of the invention will become apparent from the following detailed description when read in conjunction with the drawings.

DETAILED DESCRIPTION OF THE PREFERRED EMBODIMENT

Figure 1:
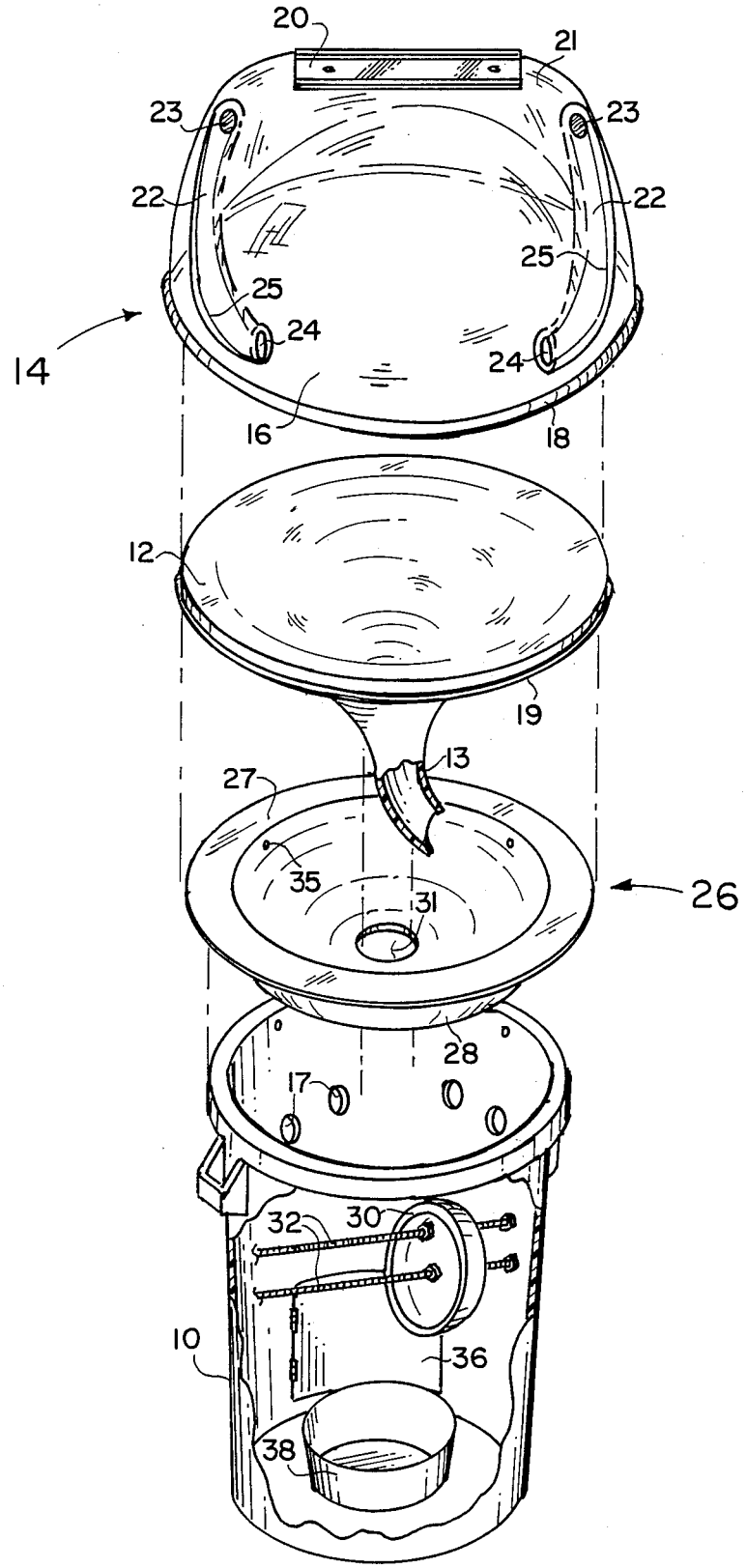
FIG. 1 shows an exploded perspective view of the amusement device of the invention with portions thereof cut away to show features of the construction.

In FIG. 1 of the drawings, an exploded perspective view of the amusement device of the invention is shown with portions thereof cut away. A container base 10, preferably molded of plastic, acts as a base of the invention. A funnel 12 and reflector 26 having diameters greater than that of container base 10 are disposed on the top of container 10 and attached thereto as will be described hereinafter. Funnel 12 may be molded or formed from a rigid transparent plastic. Funnel 12 has a convexly flared smooth inner wall surface. Reflector 26 is formed from transparent plastic to have a flat, annular ring, portion 27 and an essentially hemispherical portion 28 having a concentric opening 31 therein. Reflector 26 is aluminized or otherwise mirrored to provide a reflective surface. Cover portion 14 includes a transparent dome 16, rim molding 18, and a sign rack 20. Dome 16 is molded from a suitable transparent plastic sheet such as acrylic, polycarbonate, or other clear plastic sheet. Dome 16 has a generally hemispherical shape with a flat extended portion 21 along the top surface thereof. Portion 21 mounts an aluminum extrusion 20 into which a sign may be installed. A coin chute 22 is formed in the plastic sheet on each side of dome 16 and each chute includes an opening 24 into the interior portion of dome 16. A label or decal 23 at the upper end of chute 22 is provided to indicate the proper placement for a coin to be utilized with the invention as will be described in more detail hereinafter. The outer edges of chutes 22 include a track 25 which will guide a coin dropped from label 23 on its edge into and through slot 24.

Figure 2:
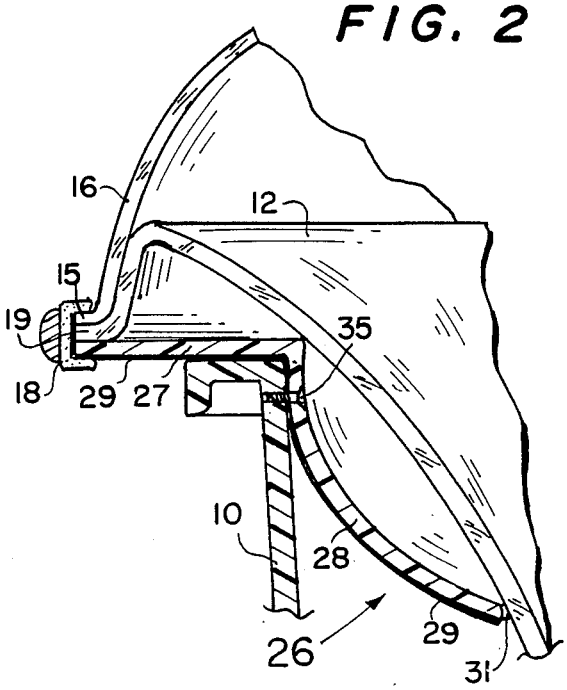
FIG. 2 is a partial cross sectional view of the funnel, reflector device, and dome portion of FIG. 1 showing the construction thereof.

Referring to FIG. 2, the attachment of cover portion 14 to funnel 12 and reflector 26 is shown in the partial cross section of these elements. As will be noted, funnel 12 includes an out turned rim 19 which rests on the outer edge of annular ring 27 of reflector 26. A metal and plastic decorative channel molding 18 is attached over rim 15 of dome 16, rim 19 of funnel 12, and ring 27 and around the peripheries thereof to form a secure, unitary structure. As will also be noted from FIG. 2, hemispherical portion 28 includes attachment holes and screws 35 for attaching funnel 12, dome 16 and reflector 26 to container base 10. Holes and screws 35 are in spaced relationship around reflector 26.

In the cutaway view of container base 10, a gong 30 is shown mounted by a pair of rods 32 to the walls of container base 10 by nuts and lock washers.

When the cover portion 14, funnel 12 and reflector 26 assembly is installed on base container 10, the curved outlet 13 of vortex funnel 12 extends through opening 31 of reflector 26 to a point immediately adjacent gong 30. Outlet 13 is curved as shown such that a coin dropping through funnel 12 will exit outlet 13 and strike gong 30. A removable coin collection tray 38 may be placed on the inner bottom surface of container base 10 to catch coins striking gong 30. A hinged access door 36 permits removal of collection box 38 when desired. Door 36 may include locking means not shown. A plurality of openings 17 is provided in the walls of base container 10 to permit the sound of gong 30 to be more clearly heard by persons utilizing the invention.

Figure 3:
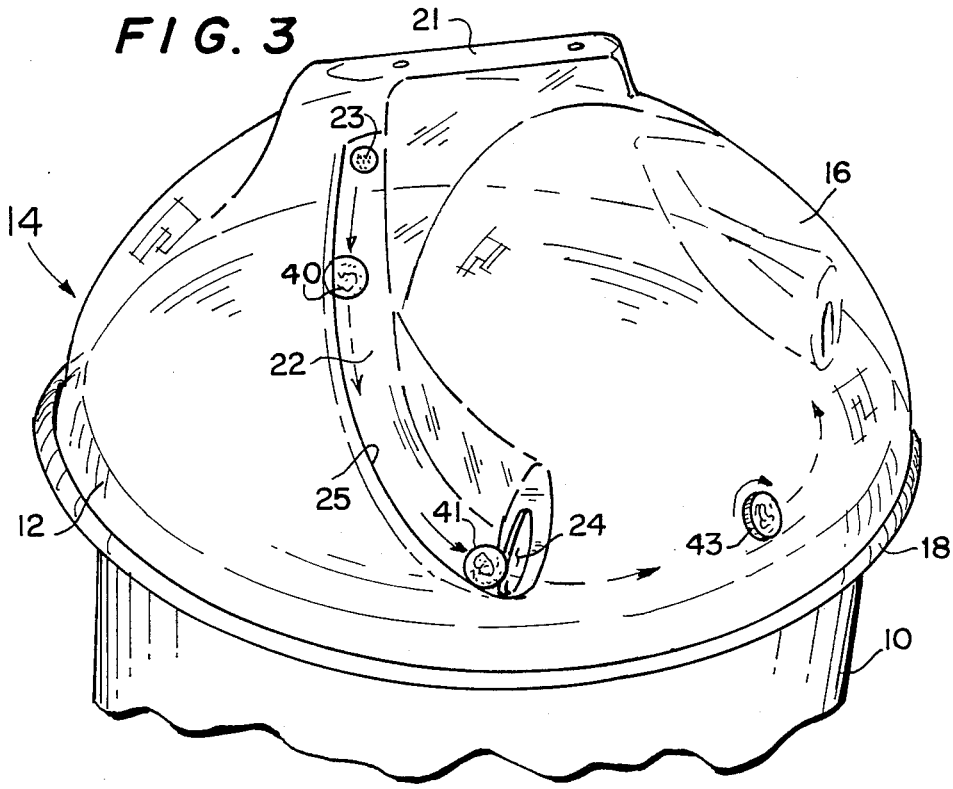
FIG. 3 is a perspective view of the dome portion of the invention illustrating the operation of the coin chutes.

The operation of the amusement device of the invention may be best understood from FIG. 3 with reference to FIG. 1. FIG. 3 shows a perspective view of cover portion 14 with details of coin chute 22 shown. Coin chute 22 is an essentially flat surface beginning in upper portion 21 and terminating near the outer periphery of dome 16 at which point an opening 24 is provided through the plastic wall to the interior of the dome 16. A track 25 is formed along the lower edge of chute 22. Label 23 may be a circular decal or sticker having a legend such as "Place coin here", instructing the user to place the coin over the label. In FIG. 3, a coin 40 has been placed over label 23 and released, moving in the direction of the arrow as shown. The edge of coin 40 rides in track 25 and will therefore roll downward. A coin 41 is shown which has completed its controlled downward movement and is passing through opening 24 and will be rolling as indicated by the peripheral arrow. The rolling coin will land on edge, as indicated by coin 43, on the outer rim of funnel 12 and tangentially with respect to the outer rim. Due to the momentum gained in its path along chute 22, it will continue to roll and will be directed into a circular path around funnel 12. Due to gravity, the coin will spiral inwardly and downwardly along the surface of the funnel. The momentum will increase as the coin rolls around the funnel and its velocity will be continually increasing due to the decreasing circumference of its path and the conservation of momentum principle. The increased velocity will slow the vertical rate of descent of the coin to the outlet. It may be noted also that a coin inserted in the opposite track from that of FIG. 3 will travel in the opposite direction. Thus, an interesting effect is produced by coins moving in opposite directions.

The presence of reflector 26 with hemispherical portion 28 spaced apart from transparent funnel 12 results in the funnel wall being essentially invisible. Thus, rolling coin 43 will appear to be floating in air. At the same time, reflective material 29, as seen in FIG. 2, on reflector 28 produces an apparent "ghost" image of a coin following and merging with coin 43. As will now be recognized, reflector 26 adds another dimension to the operation of the invention.

As will now be recognized, an amusement device which demonstrates the effects of gravity, momentum and centrifugal force has been disclosed which may be used to collect money for charitable purposes or for amusement alone. The device is totally enclosed by a transparent plastic dome to minimize theft, vandalism, or other problems present when access to the funnel is open.

While specific embodiments have been described, numerous changes will be possible to those of skill in the art without departing from the spirit and scope of the invention.

We claim:

1. An amusement device for use with coins or the like comprising:

a circular transparent funnel shaped element having an outlet portion to permit an article deposited in said funnel shaped element to drop therethrough by gravity;

an essentially hemispherical reflector having a concentric opening therethrough, said reflector disposed below said funnel and spaced apart therefrom with said outlet portion thereof extending through said opening;

support means for supporting said funnel shaped element and said reflector;

a transparent dome disposed over said funnel shaped element;

at least one article directing chute molded into an external surface of said dome, said chute having an input end for accepting an article and an output end including an opening into said dome through which said article is injected tangentially onto an inner surface of said circular funnel shaped element causing said article to spiral downward along said surface and to drop through said outlet, said reflector causing said article to appear to float in air; and a gong disposed below said outlet to permit said article to strike said gong as said article drops through said outlet.

2. The device as recited in claim 1 in which said funnel shaped element has a convexly flared inner wall causing tangentially injected articles to follow a downwardly spiraling path through said funnel shaped element.

3. The device as recited in claim 1 in which said support means is a circular walled container having an access door in a sidewall thereof.

4. The device as recited in claim 3 which further comprises an article collecting tray disposed in said container and below said outlet and gong.

5. The device as recited in claim 1 in which said dome includes means for mounting a sign.

6. An amusement device for collecting coins comprising:

a walled container;

a transparent circular funnel having a convexly flared inner wall and an outlet portion, said funnel disposed on and supported by said container;

a reflector having an annular ring contiguous with the periphery of said funnel and an essentially hemispherical portion concentric with and depending from said ring and having a concentric opening with said outlet portion of said funnel extending therethrough;

an essentially hemispherical transparent dome disposed over said funnel and attached to the periphery of said funnel and said reflector;

at least one coin chute molded on an external surface of said dome, said chute having an input end for accepting a coin, a downwardly directed track for guiding a coin to roll downward, and an opening through said dome to permit a coin to be injected on edge tangentially from said chute onto said inner wall with sufficient momentum to spiral around and down said convexly flared inner wall and to drop through said outlet portion; and sound producing means disposed below said outlet for producing sounds when a coin drops through said outlet.

7. The device as recited in claim 6 in which said container includes:

a coin collection tray disposed beneath said outlet; and an access door in a wall of said container for access to said tray.

8. The device as recited in claim 6 in which said sound producing means includes a gong positioned to be struck by a coin dropping through said outlet.

9. The device as recited in claim 6 in which said dome includes a flattened portion on an upper surface thereof for mounting a sign.

* * * * *